US012535251B2

(12) United States Patent
Hovardas et al.

(10) Patent No.: US 12,535,251 B2
(45) Date of Patent: Jan. 27, 2026

(54) HVAC UNIT PRESSURE, VACUUM AND CHARGING APPARATUS AND METHOD

(71) Applicant: Carrier Corporation, Palm Beach Gardens, FL (US)

(72) Inventors: Sotiri Hovardas, Pittsboro, IN (US); Adam Finney, Carmel, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 223 days.

(21) Appl. No.: 18/344,415

(22) Filed: Jun. 29, 2023

(65) Prior Publication Data

US 2024/0003604 A1 Jan. 4, 2024

Related U.S. Application Data

(60) Provisional application No. 63/357,148, filed on Jun. 30, 2022.

(51) Int. Cl.
*F25B 45/00* (2006.01)

(52) U.S. Cl.
CPC ..... *F25B 45/00* (2013.01); *F25B 2345/001* (2013.01); *F25B 2345/003* (2013.01)

(58) Field of Classification Search
CPC ..... F24F 11/49; F24F 11/48; F24F 11/30
See application file for complete search history.

(56) References Cited

U.S. PATENT DOCUMENTS

2014/0262130 A1* 9/2014 Yenni ..... F24F 11/89 165/11.1
2022/0049883 A1* 2/2022 Alfano ..... F25B 45/00

FOREIGN PATENT DOCUMENTS

WO WO-2020112819 A1 * 6/2020

* cited by examiner

*Primary Examiner* — Ana M Vazquez
(74) *Attorney, Agent, or Firm* — CANTOR COLBURN LLP

(57) ABSTRACT

A testing and charging system for a heating, ventilation and air conditioning (HVAC) system includes a testing and charging apparatus operably connectible to a refrigerant line of the HVAC system, an inert gas supply operably connected to the testing and charging apparatus, a refrigerant supply operably connected to the testing and charging apparatus, and a controller. The controller is configured to command the testing and charging apparatus to perform a pressure test of the HVAC system, command the testing and charging system to perform a vacuum test of the HVAC system, and command the testing and charging system to charge the HVAC system with refrigerant.

19 Claims, 2 Drawing Sheets

HVAC UNIT PRESSURE, VACUUM AND CHARGING APPARATUS AND METHOD

CROSS-REFERENCE TO RELATED APPLICATIONS

This application claims the benefit of U.S. Provisional Application No. 63/357,148 filed Jun. 30, 2022, the disclosure of which is incorporated by reference in its entirety.

BACKGROUND

Exemplary embodiments pertain to the art of heating, ventilation and air conditioning (HVAC) systems, and in particular to installation and charging of HVAC systems.

HVAC systems include a volume of refrigerant circulating therethrough, which is installed into the HVAC system upon installation or maintenance of the HVAC system in a process referred to as "charging" of the HVAC system. Industry is transitioning to lower global warming potential (GWP) refrigerants, in some instances prompted by government regulations. With this transition, there will be a need to use flammable refrigerants, such as those refrigerants classified as A2L, A2 or A3. Due to the flammability of such refrigerants, additional measures are required by standards and codes to ensure there are no refrigerant leaks in the HVAC system. The new UL6035-2-40 standard requires a pressure check and leak check to be performed on an HVAC system upon installation, before the system is charged with refrigerant.

BRIEF DESCRIPTION

In one embodiment, a testing and charging system for a heating, ventilation and air conditioning (HVAC) system includes a testing and charging apparatus operably connectible to a refrigerant line of the HVAC system, an inert gas supply operably connected to the testing and charging apparatus, a refrigerant supply operably connected to the testing and charging apparatus, and a controller. The controller is configured to command the testing and charging apparatus to perform a pressure test of the HVAC system, command the testing and charging system to perform a vacuum test of the HVAC system, and command the testing and charging system to charge the HVAC system with refrigerant.

Additionally or alternatively, in this or other embodiments one or more of an inert gas valve or a pressure regulator are located at the testing and charging apparatus and are operably connected to the inert gas supply to pressurize the HVAC system with inert gas for the pressure test.

Additionally or alternatively, in this or other embodiments a vacuum pump is located at the testing and charging apparatus to bring the HVAC system to a selected vacuum pressure for the vacuum test.

Additionally or alternatively, in this or other embodiments the testing and charging apparatus is operably connectible to the HVAC system between an outdoor unit of the HVAC system and an indoor unit of the HVAC system.

Additionally or alternatively, in this or other embodiments the refrigerant is a refrigerant classified as A2L, A2 or A3.

In another embodiment, a method of testing and charging a heating, ventilation and air conditioning (HVAC) system includes connecting a testing and charging apparatus to a refrigerant line of the HVAC system. The testing and charging apparatus includes an inert gas supply operably connected to the testing and charging apparatus, and a refrigerant supply operably connected to the testing and charging apparatus. A pressure test of the HVAC system is performed by pressurizing the HVAC system with inert gas from the inert gas supply via operation of the testing and charging apparatus. A vacuum test of the HVAC system is performed by bringing the HVAC system via operation of the testing and charging apparatus, and the HVAC system is charged with refrigerant from the refrigerant supply via operation of the testing and charging apparatus.

Additionally or alternatively, in this or other embodiments the charging of the HVAC system is only performed when the pressure test and the vacuum test are successful.

Additionally or alternatively, in this or other embodiments the vacuum test is only performed when the pressure test is successful.

Additionally or alternatively, in this or other embodiments the HVAC system is pressurized via operation of one or more of an inert gas valve or a pressure regulator disposed at the testing and charging apparatus.

Additionally or alternatively, in this or other embodiments the vacuum test is performed via operation of a vacuum pump disposed at the testing and charging apparatus.

Additionally or alternatively, in this or other embodiments the testing and charging apparatus is operably connected to the refrigerant line at a service port of the HVAC system.

Additionally or alternatively, in this or other embodiments the service port is located outside of a building at which the HVAC system is installed.

Additionally or alternatively, in this or other embodiments the service port is located between an outdoor unit of the HVAC system and an indoor unit of the HVAC system.

Additionally or alternatively, in this or other embodiments the refrigerant is a refrigerant classified as A2L, A2 or A3.

In yet another embodiment, a heating, ventilation and air conditioning (HVAC) system includes an indoor unit located inside a building to be conditioned by the HVAC system, and an outdoor unit located outside the building. The outdoor unit is operably connected to the indoor unit via a refrigerant line. A testing and charging system, includes a testing and charging apparatus operably connectible to the refrigerant line, an inert gas supply operably connected to the testing and charging apparatus, a refrigerant supply operably connected to the testing and charging apparatus, and a controller. The controller is configured to command the testing and charging apparatus to perform a pressure test of the HVAC system, command the testing and charging system to perform a vacuum test of the HVAC system, and command the testing and charging system to charge the HVAC system with refrigerant.

Additionally or alternatively, in this or other embodiments one or more of an inert gas valve or a pressure regulator is located at the testing and charging apparatus and operably connected to the inert gas supply to pressurize the HVAC system with inert gas for the pressure test.

Additionally or alternatively, in this or other embodiments a vacuum pump is located at the testing and charging apparatus to bring the HVAC system to a selected vacuum pressure for the vacuum test.

Additionally or alternatively, in this or other embodiments the testing and charging apparatus is operably connectible to the refrigerant line between the outdoor unit and the indoor unit.

Additionally or alternatively, in this or other embodiments the refrigerant is a refrigerant classified as A2L, A2 or A3.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
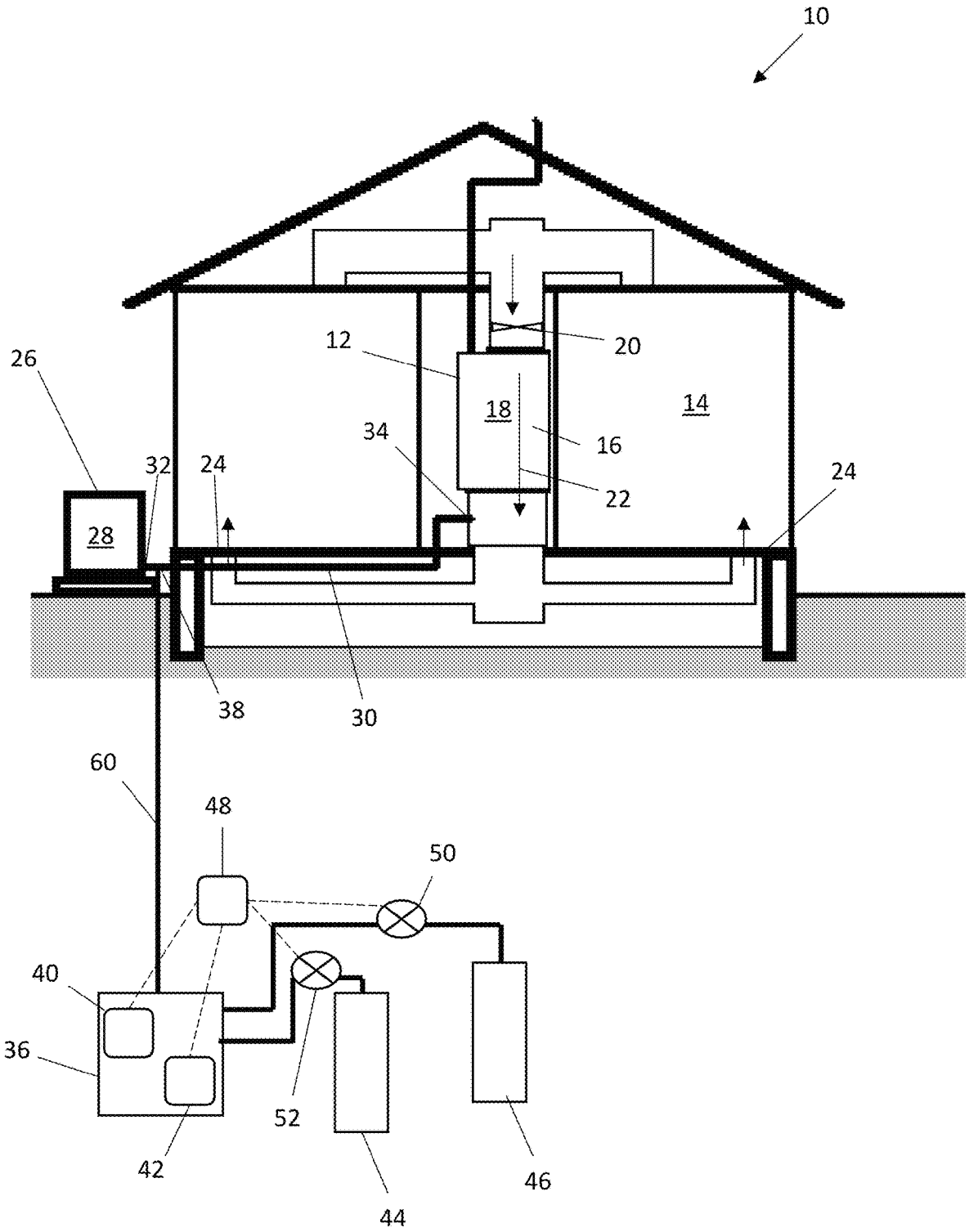
FIG. 1 is a schematic illustration of an HVAC system and a testing and charging apparatus in accordance with exemplary embodiments.

Referring now to FIG. 1, illustrated is an embodiment of a building 10, for example a dwelling or other enclosed space. A heating, ventilation and air conditioning (HVAC) system 12 is installed at the building 10 to provide conditioned air, either heated or cooled, to an interior 14 of the building 10. The HVAC system 12 includes an indoor unit 16, which includes an indoor heat exchanger 18 and in some embodiments a fan 20 to urge airflow 22 across the indoor heat exchanger 18 and out into the interior 14 through one or more ducts 24.

An outdoor unit 26 is located outside of the building 10 and includes an outdoor heat exchanger 28. The outdoor unit 26 is connected to the indoor unit 16 by refrigerant lines 30 which are configured for circulation of a flow of refrigerant between the outdoor unit 26 and the indoor unit 16. The refrigerant lines 30 are connected to the outdoor unit 26 via outdoor connections 32, and similarly the refrigerant lines 30 are connected to the indoor unit 16 via indoor connections 34. While the embodiments described herein are in the contest of a split HVAC system 12 having an indoor unit 16 and an outdoor unit 26, one skilled in the art will readily appreciate that the subject disclosure may be similarly applied to a packaged HVAC system 12, in which the components of the HVAC system 12 reside in a common package or housing.

A testing and charging apparatus 36 is connectible to the HVAC system 12 (e.g., for use during installation or maintenance of the HVAC system 12). The testing and charging apparatus 36 is utilized to perform a pressure test on the HVAC system 12, a vacuum test on the HVAC system 12 and to charge the HVAC system 12 with a selected volume of refrigerant. The tests may be performed on the HVAC system 12 as a whole, or alternatively on one of the indoor unit 16 or the outdoor unit 26. The testing and charging apparatus 36 is connected to service ports 38 located at the outdoor unit 26, which are connected to the refrigerant lines 30 via connection lines 60 extending from the testing and charging apparatus 36 and the service ports 38. In some embodiments, the service ports 38 are located outside of the building 10 between the building 10 and the outdoor unit 26. The testing and charging apparatus 36 includes a pressure regulator 40 utilized for the pressure test and charging operations, and includes a vacuum pump 42 utilized for the vacuum test. Further, an inert gas cylinder 44 containing a volume of inert gas, and a refrigerant cylinder 46 containing a volume of refrigerant, are operably connected to the testing and charging apparatus 36. In some embodiments, the refrigerant is a low global warming potential (GWP) refrigerant, for example a refrigerant classified as A2L, A2 or A3. The testing and charging apparatus 36 further includes a controller 48 connected to the pressure regulator 40, the vacuum pump 42 and to refrigerant valve 50 and inert gas valve 52 to control operation of the testing and charging apparatus 36 to perform the pressure test, the vacuum test and the charging operation of the HVAC system 12.

Figure 2:
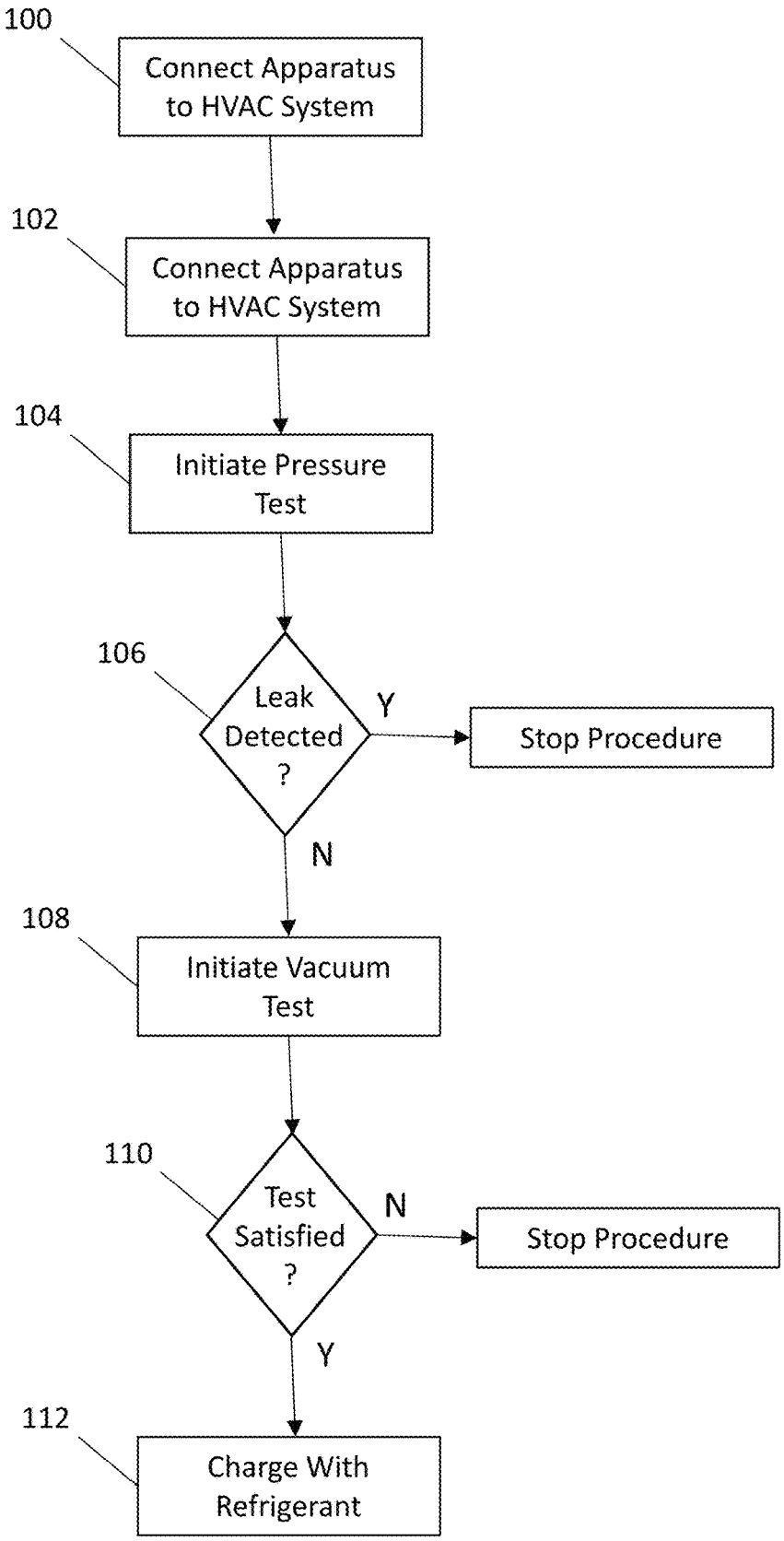
FIG. 2 is a schematic illustration of a method of testing and charging an HVAC system in accordance with exemplary embodiments.

Referring now to FIG. 2 and with continued reference to FIG. 1, a method of operation of the testing and charging apparatus 36 will be described. At step 100, a technician connects the testing and charging apparatus 36 to the HVAC system 12 at the service ports 38. The inert gas cylinder 44 and the refrigerant cylinder 46 are then connected to the testing and charging apparatus 36 at step 102. The testing and charging apparatus 36 will then be activated, and the controller 48 will initiate the pressure test at step 104. During the pressure test, the inert gas valve 52 is opened and the pressure regulator 40 is operated to flow the pressurized inert gas into the HVAC system 12 to a preselected pressure. Once the preselected pressure is reached, the testing and charging apparatus 36 monitors the pressure for a decay over time. A decay in pressure is indicative of a leak. At step 106, if a leak is detected via the pressure test, the process is stopped and the technician is notified.

At step 108, if no leak is detected via the pressure test the controller 48 initiates a vacuum test. During the vacuum test, the vacuum pump 42 is activated by the controller 48 and the HVAC system 12 is brought to a vacuum pressure below a selected level. If the vacuum pressure does not increase to a threshold level during a preselected time frame, the vacuum test requirements are satisfied. Additionally, if the selected vacuum pressure level cannot be reached, the vacuum test requirements are not satisfied. If the vacuum test requirement is not satisfied, the process is stopped and the technician is notified at step 110. If no leak is detected during the vacuum test, the controller 48 initiates charging of the HVAC system 12 with refrigerant at step 112. During charging of the HVAC system 12, the refrigerant valve 50 is opened and high pressure refrigerant flows into the HVAC system 12 from the refrigerant cylinder 46. In some embodiments, refrigerant is already present in the outdoor unit 26 during this process, and is released to the indoor unit 16 by opening the service valves 32, and the charge of the HVAC system 12 is adjusted as needed as described below. In some embodiments, the volume of refrigerant added to the HVAC system 12 is determined during the pressure check, based on the volume of inert gas added to the HVAC system 12 during the pressure check. In some embodiments, the volume of inert gas added is determined via a flowmeter or via pressures/temps of the inert gas. Additionally, superheat and subcooling values of the HVAC system 12, via one or more pressure sensors and temperature sensors to optimize the refrigerant charge on the HVAC system 12.

Utilizing the testing and charging apparatus 36 incorporates testing and charging of the HVAC system 12 into a single package and automates the timely process via the controller 48. This may also reduce the amount of warranty claims on a unit by ensuring it is commissioned correctly and the required safety checks by code have been done properly.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A testing and charging system for a heating, ventilation and air conditioning (HVAC) system, the testing and charging system comprising:

a testing and charging apparatus operably connectible to a refrigerant line of the HVAC system;

an inert gas supply operably connected to the testing and charging apparatus;

a refrigerant supply operably connected to the testing and charging apparatus; and a controller configured to:

command the testing and charging apparatus to perform a pressure test of the HVAC system utilizing a volume of inert gas flowed into the refrigerant line of the HVAC system from the inert gas supply;

command the testing and charging system to perform a vacuum test of the HVAC system; and command the testing and charging system to charge the HVAC system with refrigerant.

2. The testing and charging system of claim 1, further comprising one or more of an inert gas valve or a pressure regulator disposed at the testing and charging apparatus and operably connected to the inert gas supply to pressurize the HVAC system with inert gas for the pressure test.

3. The testing and charging system of claim 1, further comprising a vacuum pump disposed at the testing and charging apparatus to bring the HVAC system to a selected vacuum pressure for the vacuum test.

4. The testing and charging system of claim 1, wherein the testing and charging apparatus is operably connectible to the HVAC system between an outdoor unit of the HVAC system and an indoor unit of the HVAC system.

5. The testing and charging system of claim 1, wherein the refrigerant is a refrigerant classified as A2L, A2 or A3.

6. A method of testing and charging a heating, ventilation and air conditioning system, comprising:

connecting a testing and charging apparatus to a refrigerant line of the HVAC system, the testing and charging apparatus including:

an inert gas supply operably connected to the testing and charging apparatus; and a refrigerant supply operably connected to the testing and charging apparatus;

performing a pressure test of the HVAC system by pressurizing the HVAC system with inert gas flowed into the refrigerant line of the HVAC system from the inert gas supply via operation of the testing and charging apparatus;

performing a vacuum test of the HVAC system by bringing the HVAC system via operation of the testing and charging apparatus; and charging the HVAC system with refrigerant from the refrigerant supply via operation of the testing and charging apparatus.

7. The method of claim 6, wherein the charging of the HVAC system is only performed when the pressure test and the vacuum test are successful.

8. The method of claim 6, wherein the vacuum test is only performed when the pressure test is successful.

9. The method of claim 6, wherein the HVAC system is pressurized via operation of one or more of an inert gas valve or a pressure regulator disposed at the testing and charging apparatus.

10. The method of claim 6, wherein the vacuum test is performed via operation of a vacuum pump disposed at the testing and charging apparatus.

11. The method of claim 6, wherein the testing and charging apparatus is operably connected to the refrigerant line at a service port of the HVAC system.

12. The method of claim 11, wherein the service port is disposed outside of a building at which the HVAC system is installed.

13. The method of claim 11, wherein the service port is disposed between an outdoor unit of the HVAC system and an indoor unit of the HVAC system.

14. The method of claim 6, wherein the refrigerant is a refrigerant classified as A2L, A2 or A3.

15. A heating, ventilation and air conditioning (HVAC) system, comprising:

an indoor unit disposed inside a building to be conditioned by the HVAC system;

an outdoor unit disposed outside the building, the outdoor unit operably connected to the indoor unit via a refrigerant line; and a testing and charging system, including:

a testing and charging apparatus operably connectible to the refrigerant line;

an inert gas supply operably connected to the testing and charging apparatus;

a refrigerant supply operably connected to the testing and charging apparatus; and a controller configured to:

command the testing and charging apparatus to perform a pressure test of the HVAC system utilizing a volume of inert gas flowed into the refrigerant line of the HVAC system from the inert gas supply;

command the testing and charging system to perform a vacuum test of the HVAC system; and command the testing and charging system to charge the HVAC system with refrigerant.

16. The HVAC system of claim 15, further comprising one or more of an inert gas valve or a pressure regulator disposed at the testing and charging apparatus and operably connected to the inert gas supply to pressurize the HVAC system with inert gas for the pressure test.

17. The HVAC system of claim 15, further comprising a vacuum pump disposed at the testing and charging apparatus to bring the HVAC system to a selected vacuum pressure for the vacuum test.

18. The HVAC system of claim 15, wherein the testing and charging apparatus is operably connectible to the refrigerant line between the outdoor unit and the indoor unit.

19. The HVAC system of claim 15, wherein the refrigerant is a refrigerant classified as A2L, A2 or A3.

* * * * *